US005478366A

United States Patent [19]

Teo et al.

[11] Patent Number: 5,478,366

[45] Date of Patent: Dec. 26, 1995

[54] PUMPABLE LIGNIN FUEL

[75] Inventors: Khay C. Teo; Alan P. Watkinson, both of Vancouver, Canada

[73] Assignee: The University of British Columbia, Vancouver, Canada

[21] Appl. No.: 313,968

[22] Filed: Sep. 28, 1994

[51] Int. Cl.[6] ..... C10L 1/10

[52] U.S. Cl. ..... 44/301; 44/307

[58] Field of Search ..... 44/301, 307

[56] References Cited

U.S. PATENT DOCUMENTS 4,553,978 11/1985 Yvan ..... 44/307

4,762,529 8/1988 Schulz ..... 44/307

FOREIGN PATENT DOCUMENTS 453408 2/1988 Sweden .

*Primary Examiner*—Ellen M. McAvoy

*Attorney, Agent, or Firm*—C. A. Rowley

[57] ABSTRACT

A pumpable slurry for recovering fuel value from lignin by mixing the lignin with water, fuel oil and a dispersing agent to form a stable thixotropic or near Newtonian portable slurry by coordinating the amounts of lignin, water and fuel oil to produce a substantially slurry suitable for use as a liquid fuel having a viscosity after stirring of 100 to 1,000 mPa.s.

20 Claims, 3 Drawing Sheets

PUMPABLE LIGNIN FUEL

FIELD OF THE INVENTION

The present invention relates to a method of producing a combustible liquid fuel using lignin as the principal combustion agent.

BACKGROUND OF THE INVENTION

In the production of chemical wood pulps, the wood is subjected to chemical action to dissolve the lignin and leave the cellulose to provide the cellulose fibre that is subsequently used to produce paper and the like. Black liquor is produced and contains the dissolved solids such as lignin and many of the transformed inorganic materials that are used to cook the wood. This black liquor is normally evaporated to remove water and increase its concentration and then is burned in the recovery boiler which functions both to generate heat, which is normally recovered in the form of steam and to recover chemical for reuse in the pulping operation.

Generally, in the kraft system, a smelt is formed and extracted from the bottom of the recovery furnace and the smelt is then dissolved to form what is known as green liquor. The green liquor is treated with lime to convert the green liquor to white liquor, i.e. containing sodium hydroxide and the calcium carbonate produced by this reaction is obtained as a precipitate or sludge which is washed and returned to a lime kiln wherein it is fired to produce lime for reuse in the process.

In many mills, the bottleneck to increasing production is the size of the recovery furnace. Thus, when the capacity of the recovery furnace is exceeded other means to process the black liquor have been sought. For example, it has been suggested to burn the excess liquor in a fluidized bed and produce a particulate product that may later be further processed, for example, by injection onto the reducing bed of the recovery furnace or otherwise reduced to form the source for green liquor.

Swedish patent 453,408 published Feb. 1, 1988 inventor Chaudhrui teaches a concept to recovering of heat values from lignin by precipitating the lignin from excess black liquor and burning it in a lime kiln to aid in the conversion of the sludge to the lime to provide at least a portion of the heat necessary to produce lime. One of the major problems with this technique and the other techniques of which Applicant is aware for handling suspensions of lignin for burning or other purposes is the instability of the lignin in a liquid or semi-liquid suspension as the pumpability of the lignin suspension becomes impaired, making the process difficult, and in many cases, simply not satisfactory.

BRIEF DESCRIPTION OF THE PRESENT INVENTION

It is an object of the present invention to provide a stable liquid lignin containing slurry that is readily pumpable and remains pumpable even when stored for a significant periods of time.

Broadly, the present invention relates to a pourable, thixotropic or near Newtonian, stable, lignin, water and oil slurry containing lignin in the amount of 35 to 60% water 35 to 60% and oil in the amount by weight of 0.5 to 35% of said lignin, water and oil slurry said slurry containing a dispersing agent in the amount of 50 to 50,000 parts per million (ppm) and a viscosity after stirring of 100 to 1,000 mPa.s.

The invention also relates of a method for producing a pourable thixotropic or near Newtonian stable slurry of lignin, water and fuel oil comprising mixing lignin, water, fuel oil and a dispersing agent to provide a slurry of said lignin, water and fuel oil in the form of a pourable slurry, said lignin, water and fuel oil being present in said pourable slurry in amounts by weight of 35 to 60% lignin, 35 to 60% water and 0.5 to 30% oil and containing 50 to 50,000 ppm. of a dispersing agent and having a viscosity after stirring of 100 to 1,000 mPa.s to provide a stable pourable lignin, water and fuel oil slurry.

Preferably said slurry will contain at least 1% of said fuel oil.

Preferably, said pourable slurry will contain 40% to 50%, lignin; 40 to 50% water; 5 to 20% fuel oil; and 500 to 2,000 ppm of dispersing agent.

Preferably said slurry will have a viscosity after stirring of 100 to 300 mPa.s.

Preferably the ratio of lignin/water will be in the range of 2/1 to 1/2

Preferably, said lignin will be produced by the formation of black liquor in a pulping operation to provide said lignin as a lignin water mixture and wherein an oil and water emulsion is formed by mixing oil and water and said dispersion agent before mixing said oil and water emulsion with said lignin, water mixture.

Preferably, said dispersing agent will be selected from a group consisting of non-ionic, anionic, cationic and amphoteric dispersing agents and compatible mixtures thereof.

More preferably, said dispersing agent will be a non-ionic dispersing agent.

Preferably, said dispersing agent will contain a hydrophobic, hydrocarbon group, selected from the group consisting of suitable aliphatic hydrocarbons, aromatic hydrocarbons and naphthalene hydrocarbons and a hydrophilelic group containing polar groups selected from the group of hydroxy ether bonding sulphonate or other acid groups said dispersing agent having a Hydrophile/Lipophile Balance (HLB) in the range of 4 to 20 preferably 6 to 18.

Preferably, said fuel oil will be selected from the group of hydrocarbon oil including kerosene, diesel, fuel oil, bunker oil, white oil, paraffin oil, naphthalene oil, coal oil, coal tar, shale oil, tall oil, wood oil (e.g. oil distilled from wood) and including vegetable oils, tar oils, paraffinic wax oils, edible fat and their derivatives.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
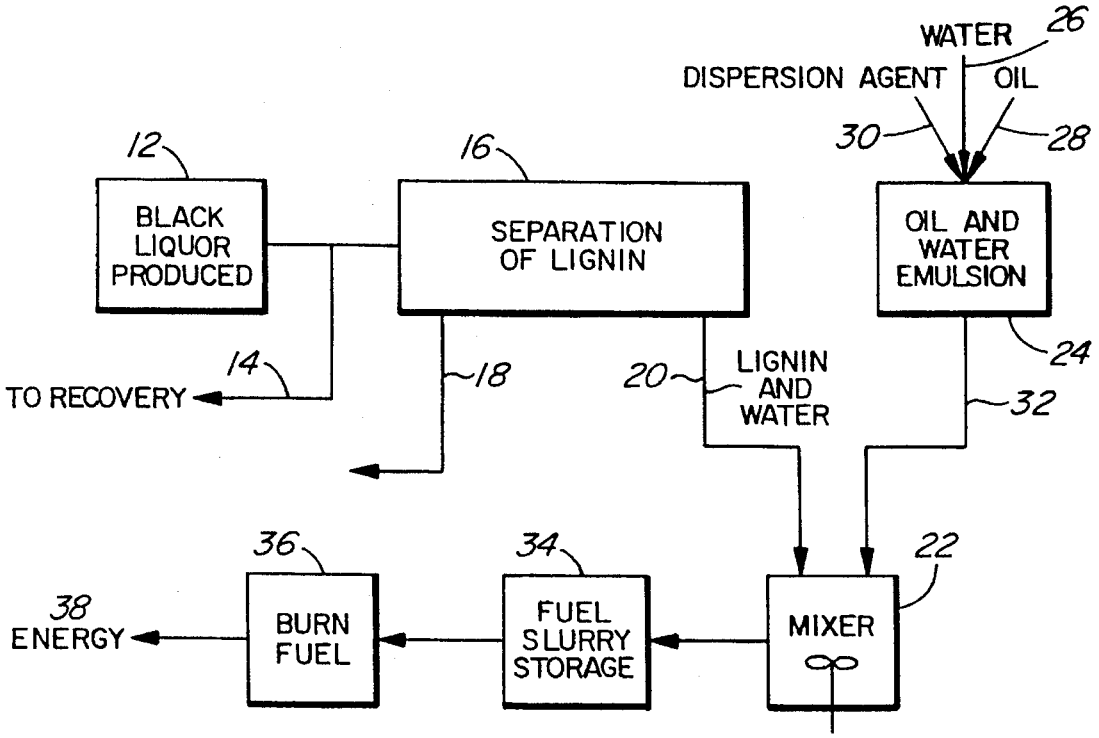
FIG. 1 is a schematic illustration of a process incorporating the present invention.

A typical system incorporating the present invention is shown in FIG. 1 wherein the invention has been applied to a black liquor recovery system e.g. a Kraft mill (it will be apparent that the invention may also be used with lignin from other sources). In this system, black liquor is produced as indicated at 12 and a portion thereof is fed to the conventional recovery system of the pulp mills indicated at 14 and the excess that will not be handled by the recovery system is delivered to a preparation stage 16 wherein lignin is separated from some of the other inorganic chemicals in the black liquor. These chemicals are removed from the system and possibly sent to the recovery system as indicated at 18 or otherwise recovered or disposed of.

A lignin water mixture leaves the lignin separation zone 16 as indicated by the line 20 and is fed to a mixer 22 which preferably will be a high shear type mixer used to form the stable pourable fuel slurry of the invention.

To produce a stable portable slurry suitable in accordance with the present invention and suitable as a liquid combustion fuel, it is preferred to first form an oil and water emulsion by introducing water, oil and a suitable dispersion agent as indicated by the lines 26, 28 and 30 respectively into a mixer 24 which preferably will be a high shear mixer to form an oil and water emulsion. The emulsion is removed from the mixer 24 and carried via a line 32 to the high shear mixer 22 where it is mixed with the lignin and water mixture in line 20.

If desired, the lignin water mixture may be replaced with substantially dry lignin, i.e. be substantially free of water and the required water added either separately or as a part of the oil and water emulsion. However, in the recovery system, as illustrated, the resultant lignin product generally contains about 40% water and it is preferred to use the water contained in the lignin or containing the lignin as the essential ingredients (together with the oil and further water dispersion agent) to form the slurry in mixer 22.

If desired the slurry may be formed by simultaneously mixing the lignin, water, dispersing agent and oil in the same high shear mixer, however when adding all these elements to the same mixer the mixing time may be longer.

The pourable fuel slurry produced in mixer 22 may be stored as indicated at 34 and eventually burned as a fuel as indicated at 36 or may be burned directly (without being stored i.e. pass directly from mixer 22 to burner 36) to form energy as schematically represented by the arrow 38.

The important characteristics of the fuel slurry leaving the mixer 22 is its stability as a slurry and it thixotropic or near Newtonian properties whereby it may be stored for significant periods of time without becoming phase separated and so that after stirring it may later be pumped i.e. have a pumpable viscosity after stirring of 100 to 1,000 mPa.s, preferably 100 to 300 mPa.s so that it may be pumped and atomized to be burned as a liquid fuel in a suitable burner to produce energy at the desired time i.e. after storage. The slurry formed in mixer 22 is easily pumpable and even if the slurry becomes relatively thick on standing, a very minor stirring will make the standing slurry revert to a low viscosity (100 to 1,000 mPa.s) pourable slurry again. Thus, the resultant stable slurry is an extremely good source of fuel that may be used on demand and may conveniently be pumped and used in conventional nozzles (suitably modified if necessary) to handle the pumpable fuel.

In order to produce the stable fuel slurry of the present invention, it is important, in fact, it is essential that the three major ingredients, namely, the lignin, water and fuel oil, be present in the required ratio i.e., the amount of each of the ingredients must be controlled to produce the stable pourable slurry. If outside material including the dispersing agent are not present in the required amounts the slurry produced will be unstable may result in separation, i.e. separation of water from the hydrocarbon portion of the slurry so that the slurry is not effective, either because it cannot be pumped properly or because there is a phase separation resulting in the slurry being unusable as a liquid fuel.

Figure 2:
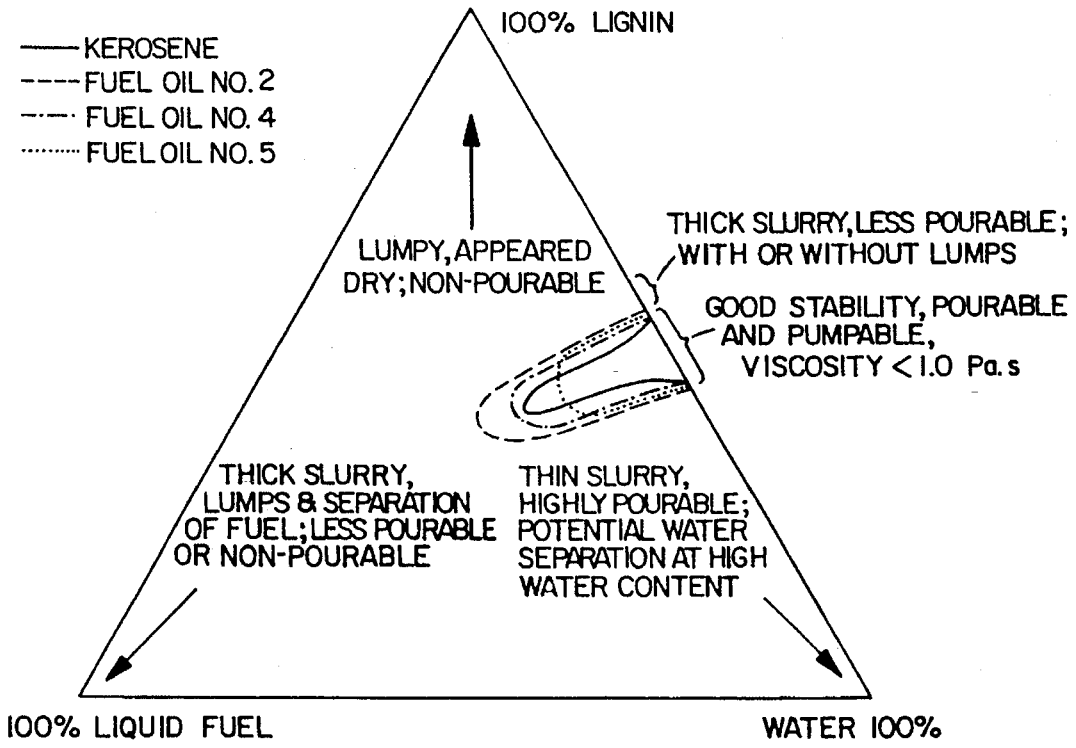
FIG. 2 is a phase diagram showing the region where stable oil, water and lignin pourable slurries are formed using several specific oils, with water and a lignin in accordance with the present invention are formed.

As shown in FIG. 2, the ratio of lignin to water to fuel oil will vary to some degree, depending on the type of fuel oil used and the origin of the lignin. Examples shown in the phase diagram of FIG. 2 are for kerosene, fuel oil no. 2, fuel oil no. 4 and fuel oil no. 5 with lignin sold under the tradename Inulin AT sold by Westvaco. It can be seen that the maximum range of ingredients was permitted with fuel oil no. 4. However, the amount of lignin will normally not be less than about 35% by weight of the mixture and generally will not exceed 60%. and preferably will be present in the amount of 40 to 50% by weigh of the slurry. Water also will normally be present in the range of between 35% and 60% preferably 40 to 50% and the fuel oil in the range of 0.5% to 30% normally at least 1% and most preferably 5 to 20%.

The lignin/water ratio in the slurry and will normally be in the range of between 2/1 and 1/2.

While slurries containing little if any oil may be produced that are stable and thixotropic or near Newtonian if there is sufficient dispersing agent, it is much better to use at least 1% by weight oil and preferably at least 5% oil by weight.

The fuel oils that may be used with the present invention comprise a wide variety of different fuel oils but in the examples plotted in FIG. 2, kerosene and three other types of fuel oils have been used.

It is believed most hydrocarbon, petroleum or coal based oil, source synthetic carbon oils may be used, including kerosene, diesel fuel, fuel oil, bunker oil, white oil, paraffinic oil, naphathenic oil, coal oil, coal tar, shale oil, wood oil, etc. It is also possible to use non-hydrocarbon oils such methods in vegetable oils, tall oil, paraffinic wax oil, animal fat and their derivatives provided they have the required ability to form the desired emulsion, water, lignin and oil.

The dispersing agent is on of the more important ingredient for ensuring the stability of the slurry and will be present in the amount of at least 50 ppm and generally will not exceed 50,000 ppm and preferably will be in the range of 500 to 2,000 ppm. the actual amount of course being dispersing agent dependent. The dispersing agent contribute significantly to the cost of the slurry but adds little if any recoverable calorific value in the fuel and therefore form an economic point of view it is preferred to hold the amount of dispersion agent low but sufficient to ensure the slurry has the required properties.

Figure 3:
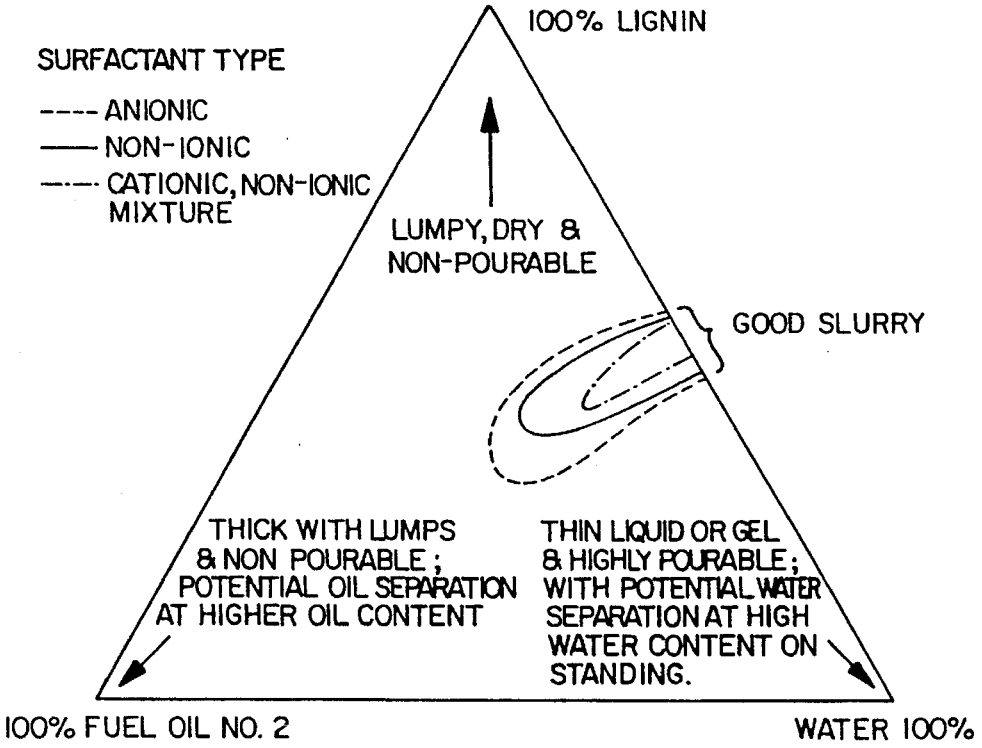
FIG. 3 is a phase diagram similar to FIG. 2 illustrating the effect of different dispersing agents on the relative amounts of oil, lignin and water that may be present in the pumpable slurry.

The selection of the dispersing agent also has a significant influence on the amounts of lignin, water and oil that may be combined into a slurry having the required characteristics of the present invention. Examples of the effect of examples of different dispersing agents on the ratios of the lignin (Inulin™ AT), water and oil in the slurry are shown in FIG. 3. The anionic surfactant was sodium dodecyl sulphate; the non-ionic Tergitol™ NP-9; and the cationic non-ionic mixture was a mixture of benzalkonium chloride (major component) and Tergitol™ NP-9 respectively.

The dispersion agents used will normally be surfactant containing hydrophobic, hydrocarbon groups such as aliphatic hydrocarbon groups, aromatic s hydrocarbon groups and naphathenic hydrocarbon groups together with hydrophillic groups particularly polar groups such as hydroxy, ether bonding, sulphonate, other acid groups and their derivatives. The non-ionic surfactants will normally have a Hydrophile/Lipophile Balance (HLB) in the range of 4 to 20 preferably 6 to 18.

Generally, the surfactant or surface active agent used as a dispersing agent with the present invention will be non-ionic, anionic or cationic.

Emulsions produced in practising the present invention are lignin, oil, water, emulsion in the form of slurry or sols that have characteristics similar to most other liquid fuels in that they may be pumped, sprayed or atomized and combusted in the combustion chamber and may be used as a primary or supplemental fuel in various applications including lime kiln.

Normally, an emulsion of oil and water is first produced and then the lignin is added to the emulsion of oil and water in a mechanical agitator, i.e. high shear mixer 22.

It will be apparent that the temperature used in the preparation of the pumpable slurry of the present invention will be above the freezing point and below the boiling point of the water phase of the emulsion and preferably will be substantially at room temperature i.e. between about 10° and 65° C. The actual temperature, provided it is not above the boiling point or below the freezing point of water, does not play a major role in formation of the emulsion or gel.

EXAMPLES

In the examples the viscosity measurements were made using a HAAKE Viscosity meter (model VT501) at 20° C. using a sensor probe SV2P. The viscosity measurements were made under constant shear rate of about D=460 per second for a ten minute period.

Example 1

1.0 grams (g) of Tergitol™ NP-9 a non-ionic surfactant sold by Union Carbide was dissolved in 214 g of water (≈15° C.) and 75 g of no. 2 fuel oil was emulsified with the water and surfactant under high shear mixing conditions. 210 g of lignin (moisture content 2%) was slowly added to the emulsion over a 3 to 5 minute period while the emulsion was subjected to the high shear conditions and a lignin-oil-water slurry having a viscosity of 0.14 to 0.16 Pa.s at 20° C. was produced. The composition of the slurry was; lignin 41.2%; 15% fuel oil; 43.6% water; and 0.2% (i.e. 2,000 ppm) surfactant. The slurry was easily pumpable and could be used as a liquid fuel and did not result in phase separation after storage.

Example 2

0.5 g of a cationic surfactant benzalkonium chloride sold by Sigma Chemicals was dissolved in 205 g of water (≈15° C.) and 75 g of no. 3 fuel oil was emulsified with the water and surfactant under high shear conditions. 210 g of lignin (moisture content 2%) was slowly added to the emulsion over a 3 to 5 minute period while the emulsion was subjected to the high shear conditions. At the end of the lignin addition the resultant slurry was dough-like and lumpy. An aqueous solution of the non-ionic surfactant Tergitol™ NP-9 (0.25 g of Tergitol in 10 g water) was added and hand mixed into the slurry and the whole blended under high shear conditions for 2 minutes and a lignin-oil-water slurry having a viscosity of 0.12 to 0.15 Pa.s at 20° C. was produced. The composition of the slurry was; lignin 41.1%; 15% fuel oil; 43.8% water; 0.1% benzalkonium chloride (i.e. 1,000 ppm) and 0.06% (i.e. 6,00 ppm) Tergitol™ NP-9. The slurry so produced was easily pumpable and could be used as a liquid fuel and did not result in phase separation after storage.

Example 3

1.0 grams (g) of Tergitol™ NP-9 a non-ionic surfactant sold by Union Carbide was dissolved in 20 g of water (≈15° C.) and 100 g of no. 4 fuel oil was emulsified with the water under high shear mixing conditions. 375 g of lignin cake containing 50% moisture was slowly added to the emulsion over a 3 to 5 minute period while the emulsion was subjected to the high sear conditions and a lignin-oil-water slurry having a viscosity of 0.20 to 0.23 Pa.s at 20° C. was produced. The composition of the slurry was; lignin 37.8%; 20.2% fuel oil; 41.8% water; and 0.2% (i.e. 2,000 ppm) surfactant. The slurry was easily pumpable and could be used as a liquid fuel and did not result in phase separation after storage.

Example 4

160 g of Terigtol™ NP-9 together with 35.2 kg of water and 12 kg of fuel oil No. 2 were homogenised in a tank to form an oil;-in-water emulsion. 32.65 kg of Indulin AT™ lignin (sold by Westvaco.) containing 2% by weight moisture was added gradually (in portions) to the oil-in-water emulsion and mixed under high shear conditions at a temperature between 18 and 25° C. The resultant stable slurry contained 40% lignin; 15% fuel oil no. 2; 44.8% water; and 0.2% (i.e. 2,000 ppm) surfactant. This produced an 80 kg sample for testing in a lime kiln.

Example 5

To demonstrate the properties of slurries of the present invention a slurry the viscosity of a freshly prepared slurry containing 50.9% lignin, 47.9% water 1.0 fuel oil and 0.2% surfactant was determined and the slurry left for a time sufficient is to form a highly viscous solid looking slurry and then subjected to the stirring operation and the viscosity again determined. The viscosity of the fresh slurry was 0.22 Pa.s and the viscosity after storage and mixing was 0.13 Pa.s and there was no indication of phase separation indicating that after storage for some time the slurry was still at least as suitable as a liquid fuel as immediately after it was produced.

A similar composition but containing no fuel oil; 51.4% lignin; 48.4% water and 0.21% surfactant the viscosity of the fresh slurry was in the order of 0.31 Pa.s and when the surfactant was also omitted the viscosity increased substantially to 0.77 Pa.s for a composition containing 51.5% lignin and 48.5% water. If the ratio of lignin to water is decreased the viscosity can be reduced, but the fuel value becomes too low to perform satisfactory as a fuel.

Example 5

Figure 4:
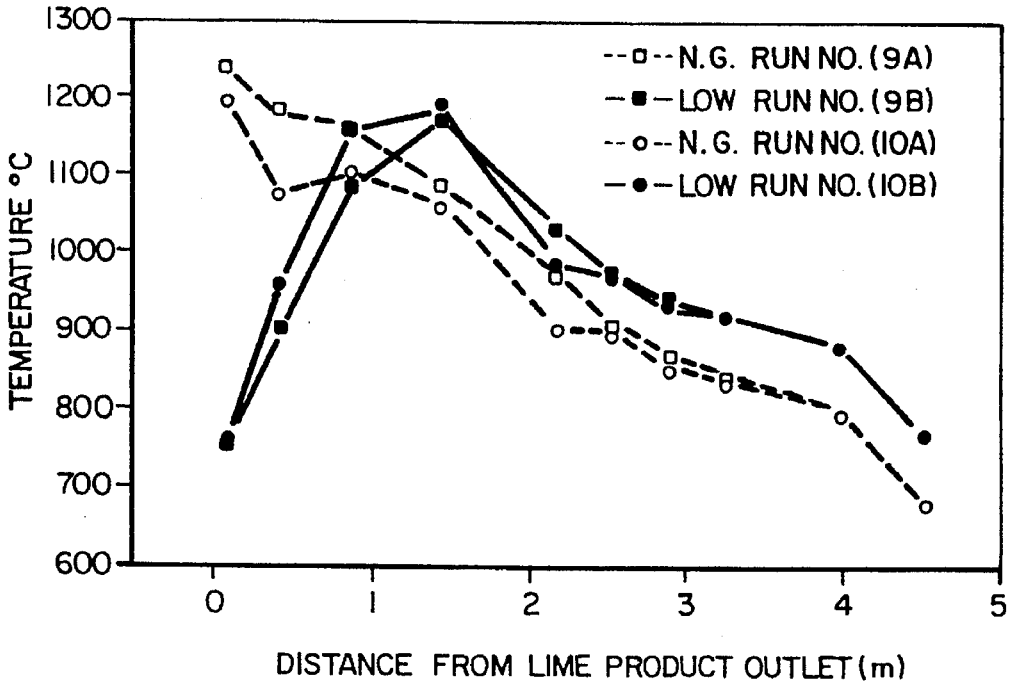
FIG. 4 is a free board temperature in a lime kiln versus position along the kiln length.
Figure 5:
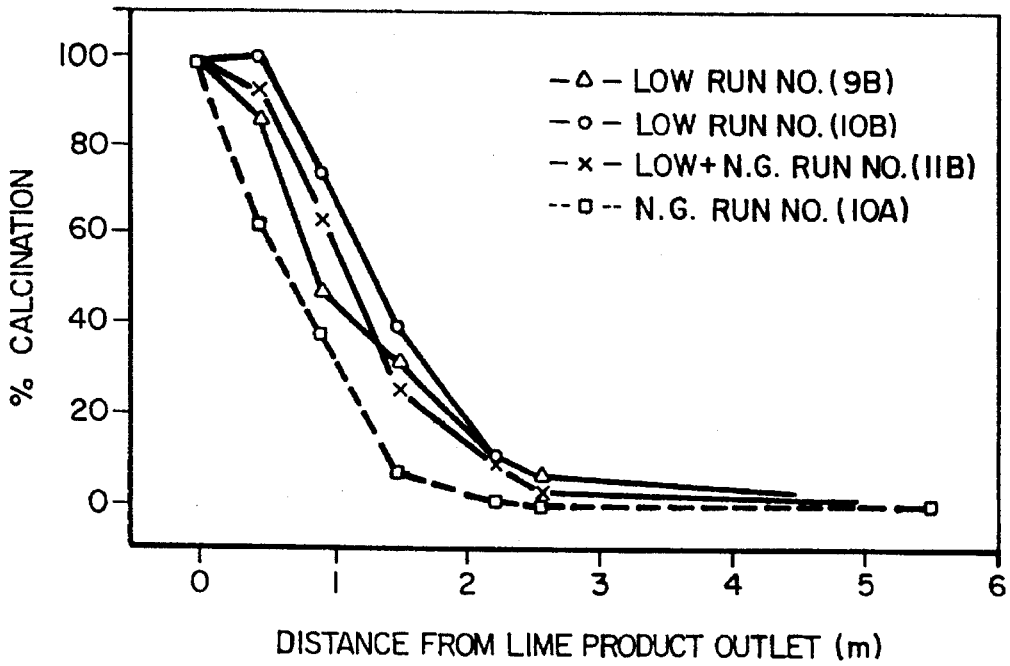
FIG. 5 is a graph similar to FIG. 3 but showing degree of calcination in the kiln versus position along the length of the kiln.

A slurry formed in accordance with the present invention was used as a fuel for a pilot scale lime kiln and the operation of the lignin oil, water emulsion or pourable slurry of the present invention was compared with that obtained using natural gas, and dry lignin. Results are clearly shown in FIGS. 4 and 5 and it can be clearly be seen that the emulsions of the present invention provide at least the same amount of heat as that obtained using the conventional, natural gas and in many cases provided more heat than is available from the other fuels tested.

Table 1 shows typical results including fuel, fuel rate, percent oxygen in the flue gas and the analysis of the lime, the ability of the lime to slake when produced using the natural gas as a fuel, lignin as a fuel or the slurry of the present invention as the fuel.

TABLE 1

| | | Typical Results of Rotary Lime Kiln Trials | | | | | | |
|---|---|---|---|---|---|---|---|---|
| | | Fuel | % $O_2$ | | | | Lime Slaking | |
| | | Rate | in Flue | Lime Analysis | | | Time | Rate |
| Run | Fuel | (MJ/h) | Gas | % Cal'n | % S | % Na | (min) | °C./min |
| 9A | NG | 344 | 2.5 | 95.3 | 0.14 | 0.004 | 2.5 | 3.7 |
| 9B | LOW | 338 | 2.8 | 99.3 | 0.22 | 0.028 | 1.7 | 7.8 |
| 10A | NG | 344 | 3.2 | 94.4 | 0.15 | 0.017 | 2.8 | 4.2 |
| 10B | LOW | 347 | 2.5 | 99.3 | 0.22 | 0.032 | 2.2 | 4.1 |
| 11A | NG | 344 | 2.7 | 99.4 | 0.19 | 0.007 | 2.5 | 4.7 |
| 11B | LOW + NG | 354 | 2.5 | 99.1 | 0.19 | 0.028 | 2.0 | 6.0 |
| 11R | DL | 331 | 2.7 | 98.7 | 0.15 | 0.037 | 1.5 | 8.0 |
| 14R | DL | 344 | 2.8 | 98.8 | 0.15 | 0.040 | 1.3 | 7.6 |
| 13R | NG | 342 | 2.0 | 98.2 | 0.04 | 0.033 | 1.0 | 7.7 |
| 15R | NG | 367 | 2.5 | 98.1 | 0.04 | 0.033 | 1.0 | 7.4 |

Feed rate of $CaCO_3$ 40 kg/hr.

NG=natural gas;

LOW=lignin-oil-water;

DL=dry lignin

Runs identified in Table 1 by the equivalent numbers wherein the kiln was first fired under conditions A and then under conditions B.

It will be apparent from Table 1 that when the present invention is used as the fuel, the percent calcination obtained was always above 99%.

The amount of sulphur and sodium in the lime when the present invention was used was higher than that obtained using natural gas in most instances and less than that obtained when dry lignin was used as the fuel.

The slaking rate was the highest when dry lignin was used as the fuel. When the present invention was used as the fuel in the kiln, the slaking time was less than that required when natural gas was used as the fuel, and the slaking rate (degrees centigrade per minute) was higher somewhere in between that obtained using dry lignin and natural gas.

Where reference is made to measuring viscosity after stirring the term stirring is intended to mean stirring the thixotropic slurries by applying for example a shear rate D=460 per sec. for between 1 to 10 minutes at 20° to 25° C. i.e. until the properties of the slurry have become stabilized.

Having described the invention, modifications will be evident to those skilled in the art without departing from the scope of the invention as defined in the appended claims.

We claim:

1. A pourable, thixotropic or near Newtonian, stable, lignin, water and oil slurry consisting essentially of lignin in the amount of 35 to 60%; water 35 to 60%; and oil in the amount by weight of 0.5 to 30% of said lignin, water and oil slurry said slurry containing a dispersing agent in the amount of at least 50 parts per million (ppm) and a viscosity after stirring of 100 to 1,000 mPa.s.

2. A slurry as defined in claim 1 wherein said slurry contains at least 1% of said fuel oil.

3. A slurry as defined in claim 2 wherein said pourable slurry will contain 40% to 50% lignin; 40 to 50% water; 5 to 20% fuel oil; and 500 to 2,000 ppm of dispersing agent.

4. A slurry as defined in claim 2 wherein said slurry has a viscosity after stirring of 100 to 300 mPa.s.

5. A slurry as defined in claim 3 wherein said slurry has a viscosity after stirring of 100 to 300 mPa.s.

6. A slurry as defined in claim 2 wherein the ratio of lignin/water is in the range of 2/1 to 1/2.

7. A slurry as defined in claim 3 wherein the ratio of lignin/water is in the range of 2/1 to 1/2.

8. A slurry as defined in claim 4 wherein the ratio of lignin/water is in the range of 2/1 to 1/2.

9. A slurry as defined in claim 5 wherein the ratio of lignin/water is in the range of 2/1 to 1/2.

10. A slurry as defined in claim 2 wherein said dispersing agent is selected from a group consisting of non-ionic, anionic, cationic, and amphoteric dispersing agents and compatible mixtures thereof.

11. A slurry as defined in claim 3 wherein said dispersing agent is selected from a group consisting of non-ionic, anionic, cationic, and amphoteric dispersing agents and compatible mixtures thereof.

12. A slurry as defined in claim 5 wherein said dispersing agent is selected from a group consisting of non-ionic, anionic, cationic, and amphoteric dispersing agents and compatible mixtures thereof.

13. A slurry as defined in claim 7 wherein said dispersing agent is selected from a group consisting of non-ionic, anionic, cationic, and amphoteric dispersing agents and compatible mixtures thereof.

14. A slurry as defined in claim 9 wherein said dispersing agent is selected from a group consisting of non-ionic, anionic, cationic, and amphoteric dispersing agents and compatible mixtures thereof.

15. A slurry as defined in claim 3 wherein said fuel oil is selected from the group of hydrocarbon oils including kerosene, diesel, fuel oil, bunker oil, white oil, paraffin oil, naphthalene oil, coal oil, coal tar, shale oil, wood oil and vegetable oils, tall oils, paraffinic wax oils, edible fat and their derivatives.

16. A slurry as defined in claim 5 wherein said fuel oil is selected from the group of hydrocarbon oils including kerosene, diesel, fuel oil, bunker oil, white oil, paraffin oil, naphthalene oil, coal oil, coal tar, shale oil, wood oil and vegetable oils, tall oils, paraffinic wax oils, edible fat and their derivatives.

17. A slurry as defined in claim 7 wherein said fuel oil is selected from the group of hydrocarbon oils including kerosene, diesel, fuel oil, bunker oil, white oil, paraffin oil, naphthalene oil, coal oil, coal tar, shale oil, wood oil and vegetable oils, tall oils, paraffinic wax oils, edible fat and their derivatives.

18. A slurry as defined in claim 9 wherein said fuel oil is selected from the group of hydrocarbon oils including kerosene, diesel, fuel oil, bunker oil, white oil, paraffin oil, naphthalene oil, coal oil, coal tar, shale oil, wood oil and vegetable oils, tall oils, paraffinic wax oils, edible fat and their derivatives.

19. A method for producing a pourable thixotropic or near Newtonian stable slurry of lignin, water and fuel oil comprising mixing lignin, water, fuel oil and a dispersing agent to provide a slurry consisting essentially of said lignin, water and fuel oil in the form of a pourable slurry, having said lignin, water and fuel oil present in said pourable slurry in amounts by weight of 35 to 60% lignin, 35 to 60% water and 0.5 to 30% oil and containing at least 50 ppm. of a dispersing agent and having a viscosity after stirring of 100 to 1,000 mPa.s. to provide a stable pourable lignin, water and fuel oil slurry.

20. A method as defined in claim 19 wherein said pourable slurry will contain 40% to 50%, lignin; 40 to 50% water; 5 to 20% fuel oil; and 500 to 2,000 ppm of dispersing agent.

* * * * *